United States Patent [19]

Sinnock et al.

[11] 3,970,134

[45] July 20, 1976

[54] SECURITY LOCKING OF ROLLING SHUTTERS

[75] Inventors: Pomeroy Sinnock; Joseph Robert Lauer; David H. Manthei, all of New Castle; Arthur C. Rugg, Richmond, all of Ind.

[73] Assignee: Amrol Corporation, New Castle, Ind.

[22] Filed: July 16, 1975

[21] Appl. No.: 596,209

[52] U.S. Cl. ..... 160/133

[51] Int. Cl.[2] ..... E06B 9/08

[58] Field of Search..... 160/133, 201, 33, 23 R, 160/26, 32

[56] References Cited

UNITED STATES PATENTS

| | | | |
|---|---|---|---|
| 2,019,084 | 10/1935 | Miller | 160/133 X |
| 3,302,692 | 2/1967 | Grau | 160/133 |
| 3,529,650 | 9/1970 | Brancato | 160/133 |

FOREIGN PATENTS OR APPLICATIONS

| | | | |
|---|---|---|---|
| 1,019,074 | 11/1957 | Germany | 160/133 |
| 1,938,390 | 2/1971 | Germany | 160/133 |
| 2,108,898 | 10/1971 | Germany | 160/133 |

*Primary Examiner*—Philip C. Kannan
*Attorney, Agent, or Firm*—Woodard, Weikart, Emhardt & Naughton

[57] ABSTRACT

A rolling shutter for building wall openings, has extra-long locking slats connecting the usual shutter slats to the slat storing roller. Lock slat guide blocks located adjacent the roller and outboard of the shutter slats cooperate with the lock slats when the shutter is closed to preclude disarrangement of the lock slats by a shutter opening force externally applied to the shutter slats, when the roller is locked.

12 Claims, 3 Drawing Figures

SECURITY LOCKING OF ROLLING SHUTTERS

BACKGROUND OF THE INVENTION

1. Field of the Invention

This invention relates generally to rolling shutters for building openings, and more particularly to means for securing the shutters closed.

2. Description of the Prior Art

Rolling shutters have been known for many years. The need for locking such shutters in the closed condition has long been recognized. Devices for this purpose include bolt action bars in the bottom slat, pin locks manually inserted through a wall into a hole in the bottom slat, hinge locks, pin locks disposed between slats, sliding latches, or an offset slat. One or more of these approaches is shown in some of the following United States and foreign patents noted in the course of a preliminary search:

United States Patents

| Pat. No. | Inventor | Issue Date |
|---|---|---|
| 2,019,084 | Miller | Oct. 29, 1935 |
| 2,921,628 | Alvarez | Jan. 19, 1960 |
| 3,302,692 | Grau | Feb. 7, 1967 |
| 3,819,217 | Savino | June 25, 1974 |

German Patents

| Pat. No. | Inventor | Issue Date |
|---|---|---|
| 134,505 | Kimmich | Sept. 20, 1902 |
| 354,717 | Markgraf | June 14, 1922 |
| 1,938,390 | Kuhn | Feb. 11, 1971 |

Some of the shortcomings of the prior art locks include, for the bolt action locks, access from the inside, difficulty or impossibility of use where window screens are employed, and inability to use them where fixed windows are employed. As to the pin locks, the pins are typically loose, small, and are susceptible to bending and/or loss.

There has remained a need for a simple, reliable, inexpensive means for locking rolling shutters, and which is independent of the presence or absence of window screens, and whether or not the opening has a fixed or movable window therein, and which is as readily useful for door openings as for window openings. The present invention is directed toward meeting the need.

SUMMARY OF THE INVENTION

Described briefly in a typical embodiment of the present invention, a rolling shutter assembly is provided with the normal shutter slats, and additional lock slats, the latter being disposed adjacent the shutter storing roller and serving to connect the shutter slats to the roller. The locking slat guide means are provided to prevent an external force applied to the shutter slats (as by an intruder prying upwardly) when the shutter is closed, from bunching up or disarranging the locking slats, and they thereby preclude the displacement of the shutter slats from their correct disposition covering the opening.

DESCRIPTION OF THE PREFERRED EMBODIMENT

Figure 1:
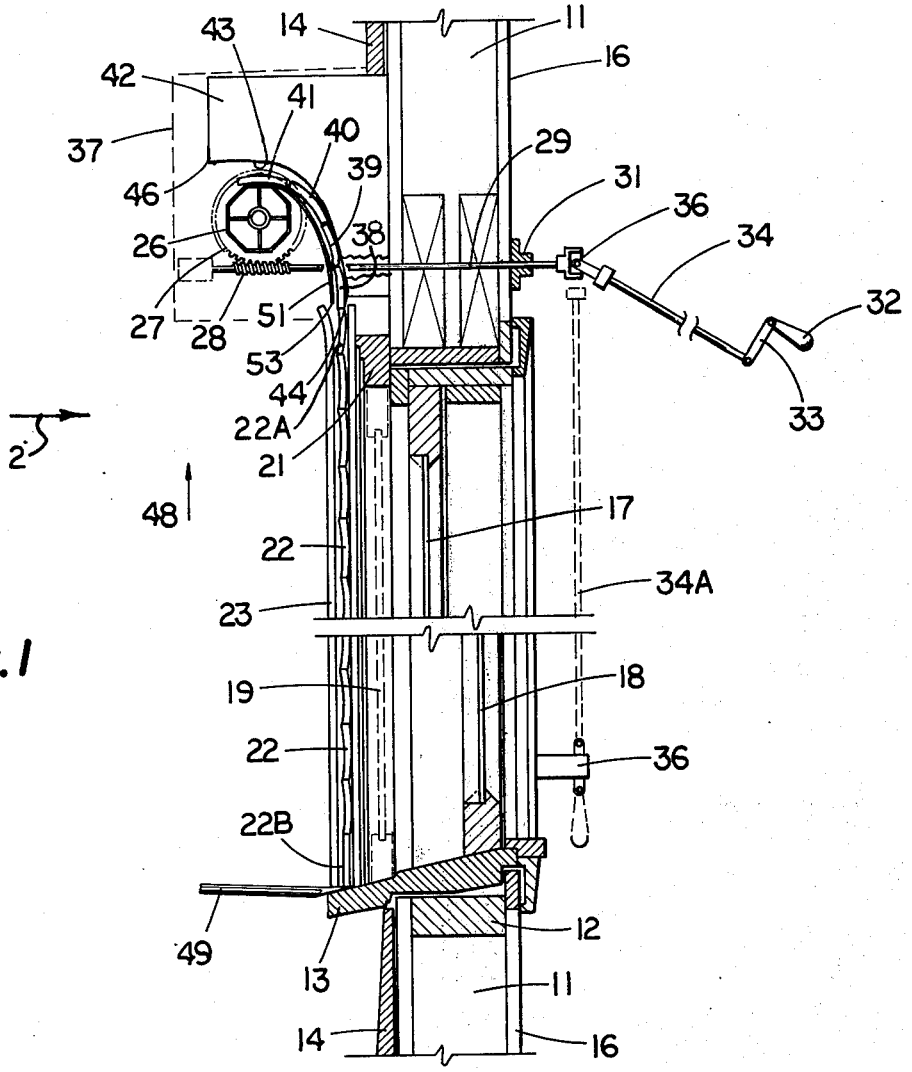
FIG. 1 is a section through a building wall at an opening therein having a shutter assembly incorporating a typical embodiment of the present invention, a portion of the shutter and wall being omitted to conserve space in the drawings.

Referring now to the drawings in detail, FIG. 1 is a section through the wall of a building at an opening therein, the type of wall being the well-known wood frame construction with wood shingle or clapboard siding. The framing studs are at 11, the sill plate 12, the window sill 13, the exterior siding at 14, and the interior wallboard at 16. The illustrated window is of the double-hung type, the upper pane thereof being shown at 17 and the lower pane at 18, the remainder of the windows being omitted from the drawing to conserve space. Although a screen is not shown in the opening, there is a space for a screen at 19, below the window frame header 21.

The shutter assembly includes the shutter slats 22 shown deployed in front of the window in the shutter-closed condition. The opposite ends of each slat are received, guided, and retained in the side guide rails 23 at the sides of the window and secured to the window frame.

For storage of the shutter slats in the shutter-open condition, a storage roller shown in the form of an octagonal drum 26, is mounted above the opening and to the exterior of the building, by means of an idler bracket assembly 28 and a crank bracket assembly 29, both of which are affixed to the exterior wall of the building and provide bearing support for the opposite ends of the roller. In the illustrated embodiment, the roller can be rolled clockwise (FIG. 1) to deploy the shutters in front of the opening, or counterclockwise to roll all of the shutters onto the roller so that the bottom slat 22B is then immediately adjacent the window frame header 21, for example. To drive the roller in the clockwise and counterclockwise direction, there is a gear 27 secured to the roller, and a pinion or worm 28 engaging the gear, the worm being mounted on a shaft 29 which extends through the wall and may be supported at the inside face of the wall in a bearing bracket 31, for example.

A crank handle 32, link 33, and shaft 34 inside the building are connected through universal joint 36 to the shaft 29. Therefore, the shaft 29 can be cranked in either rotational direction by means of the handle 32, to raise or close the shutter. When the handcrank is not being used for operation of the shutter, it can be permitted to hang at the inside of the window in the position shown by the dotted line 34A and retained in that position by a spring clip 36, for example, secured to the inside of the window frame. It will be readily recognized that instead of a handcrank, an electric motor could be connected to the shaft 29, preferably outside the building and inside the housing 37 for the rolling shutter, and operated by a reversible switch at the inside of the building. The drive for the roller can be accomplished otherwise by using an electric motor at another location, or inside the roller itself, or by using an operating strap or other means. For purposes of the present example, the drive ratio between the roller itself and the shaft driving it should be 1:5, 1:8, 1:10 or higher. That is, the number of turns of the roller per turn of the motor or crankshaft or other means driving it, should be comparatively small so that the roller cannot be turned by external force applied thereto. Of course, it is clear that when the handcrank is hanging vertically adjacent the wall on the interior of the building, and particularly if it is clipped in position, the shutter storage roller cannot be turned by an external force, without breaking something. It is intended further that the structure be of sufficient strength that it will not be broken by any external force which could be applied to the roller by pushing upward on the shutters in such manner as would tend to roll them onto the roller.

Figure 2:
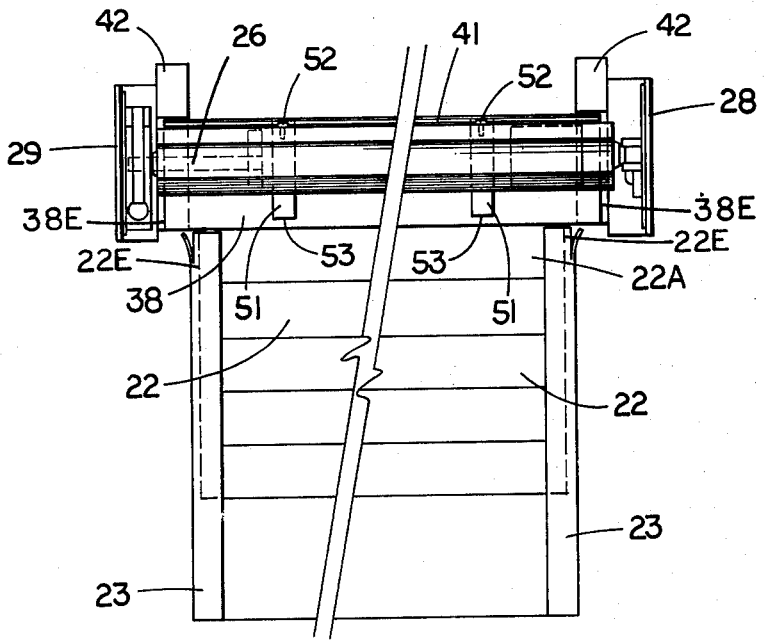
FIG. 2 is a front elevational view of the shutter assembly itself, looking in the direction of arrow 2 in FIG. 1, a portion of the shutter assembly being omitted to conserve space in the drawing.

To utilize the slat storage roller according to a typical embodiment of the present invention, locking slats are employed at 38, 39, 40 and 41. These locking slats are virtually the same as slats 22 except that, as seen in FIG. 2, they are somewhat longer, the ends of shutter slats being designated at 22E, for example, and the ends of locking slats at 38E, for example. Therefore, the end portions of the locking slats are in facing relationship to security blocks 42 affixed to the building wall according to the invention, immediately inboard of the brackets 28 and 29. Yet it will also be noted that these blocks are outboard of the ends of the slats 22. FIG. 1 shows that the block 42 has a curved slat-guiding and confining face 43 which curves upward from a point 44 immediately above the shutter slat guide rails 23, but outboard thereof, to a point 46 above and adjacent the roller 26. This surface contacts the faces of the end portions of slats 38, 39 and 40, and is very close to the end portions of slat 41. It will prevent any disarrangement or bunching upward of the slats 38, 39, 40 and 41, which might otherwise occur if an upward force were applied against them in the direction of arrow 48 as would occur, for example, if a prospective intruder inserted a wrecking bar 49 between the window sill and the bottom slat 22B of the rolling shutter in an effort to gain entry to the building through the window. Therefore, since the usual conventional construction of the shutter slats themselves and connection of one to another will prevent them from separating from each other, either when they are pulled apart or pushed together, the present invention will preclude the forcing open or upward of the shutter slats and yet not interfere with the normal rolling up thereof onto the roller 26 when it is driven by the crank, by the motor, or by the designated appropriate means. This is because the shutter slats 22 can roll up between the security blocks 42 without contact therewith, just as shutter slats normally roll onto the roller. Therefore, although conventionally the upper shutter slat 22A might be connected to the roller by a string, band, or other means which, upon rolling the roller, would pull the shutters onto the roller, according to the present invention additional slats (the lock slats) are used for that purpose and serve the additional purpose of locking the shutter in the closed position when the roller is secured from rotation.

In order to prevent the lock slats from descending or falling too far away from the guide and confining surface 43, lock springs 51 are employed and extend downward from their points of attachment by screws 52 to the roller assembly, to the lower ends 53 of the springs. These springs are flexible enough to roll onto the roller as it is rolled by means of the crank or motor as the shutter is opened. However, as the shutter is closed, the spring will unwrap from the roll and maintain the unrolling locking slats 38, 39 and 40 in constant sliding engagement with the surface 43 of each of the security blocks.

Figure 3:
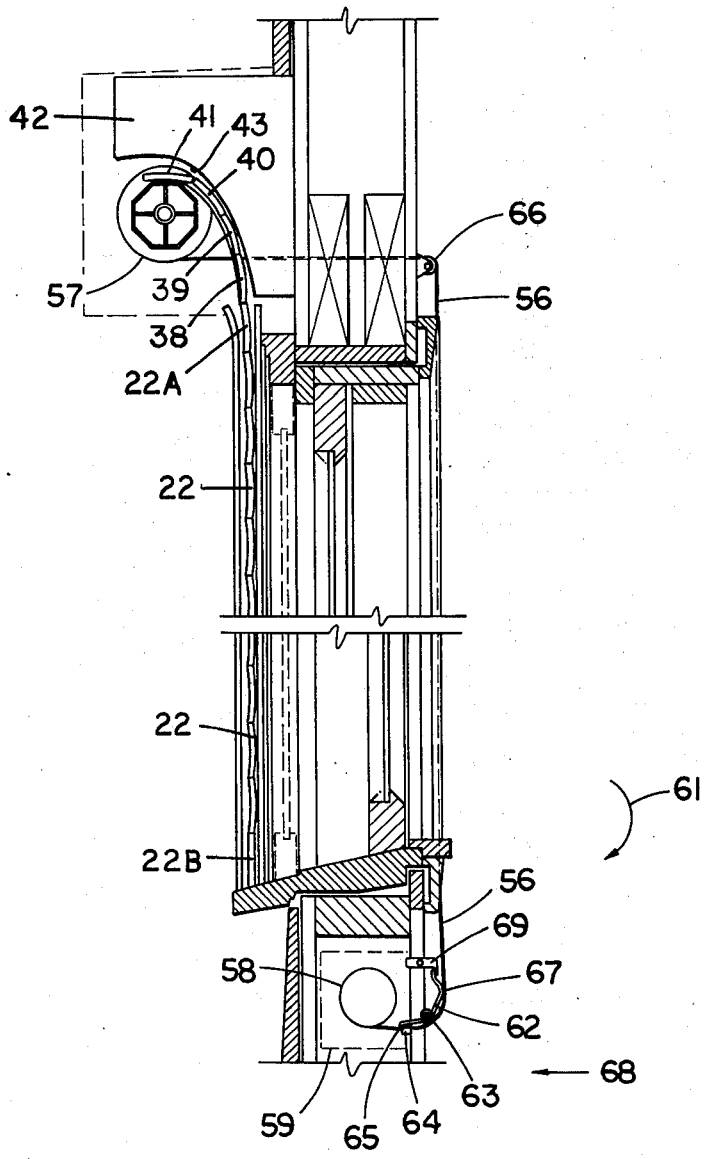
FIG. 3 is a fragmentary sectional view similar to FIG. 1 but showing the invention applied to a strap operated shutter assembly.

As shown in FIG. 3, the present invention is applicable also where the shutter is strap-operated. In that case, the locking slats and guides are the same as in the previous embodiment. However, the operating strap 56 extending from the strap reel 57 to the recoil reel 58 is used to open and close the shutter in conventional manner. The recoil spring in box 59 urges the recoil reel in the clockwise direction of arrow 61 with a force of about six or seven pounds. This is desirable particularly when the shutter is closed (most of strap wound on strap reel 57 and unwound from recoil reel 58) to aid the user in raising the shutter. The tongue 62 (shown much enlarged) pivoting on the recoil box about hinge pin 63, is capable of pinching the strap against bar 64 at 65 when the strap portion extending up to pulley 66 contacts the tongue at 67 and pushes it in the direction of arrow 68 toward the end of the recoil box. This is useful to hold the shutter in any desired partially open position, as it prevents the strap from being pulled out of the recoil box by the weight of the shutter tending to unroll more shutter from roller 26.

By providing a small clamp 69 to lock the tongue in the up (strap clamping) condition when the shutter is closed, the recoil spring cannot move the strap which is clamped against bar 64, so is unable to tend to roll up the shutter. Therefore, a would-be intruder is unable to jiggle the shutter upward, as he might otherwise be able to do if the six or seven pound pull were being exerted on the strap reel 57 by the strap 56.

It will be seen and recognized from the foregoing description that the present invention provides a convenient, inexpensive, and reliable security locking system for rolling shutters whether they be for window openings or door openings in a building.

What is claimed is:

1. In a rolling shutter having a plurality of parallel, adjacent shutter slats capable of deployment in a shutter-closed array covering an opening in a building wall, and of being roiled from the array onto a roller for a shutter-open condition to uncover the opening and for storage of the shutter slats in a roll, the improvement comprising:

a plurality of lock slats connected to the roller between the roller and the shutter slats;

lock slat guide means adjacent said roller and disposed in position to guide the lock slats and prevent disorder thereof but clear said shutter slats to accommodate accumulation thereof in a roll on said roller.

2. The improvement of claim 1 wherein:

said guide means include a pair of guide surfaces spaced apart a distance greater than the length of said shutter slats but less than the length of said lock slats.

3. The improvement of claim 2 wherein:

said roller is horizontal above the opening;

said slats are horizontal;

and said guide surfaces extend upwardly from a point adjacent the top of the opening and forwardly therefrom around a portion of said roller.

4. The improvement of claim 3 wherein:

said surface curve outwardly and downwardly from points adjacent said roller to points adjacent said opening, accommodating the rolling and unrolling of said shutter slats by rotating said roller, but precluding the rolling, collapsing, and stacking of said lock slats when said roller is locked and said shutter slats close the opening and an upward force is applied to said shutter slats below the lock slats.

5. The improvement of claim 4 wherein:

said roller has means thereon precluding the rolling thereof in a shutter slat accumulating direction by force applied to said shutter slats.

6. The improvement of claim 2 and further comprising:

spring means urging at least one of said lock slats against said guide surfaces.

7. The combination of claim 6 wherein:

said spring means include at least one spring arm having one end portion secured to said roller and another end engaging one of said lock slats, said spring being curved to contact surfaces of said lock slats when the shutter is in the shutter-closed condition and capable of resilient wrapping around said roller as said roller is rotated to roll-up said lock slats thereon.

8. The improvement of claim 7 wherein:

said spring is a flat leaf spring of arcuate configuration.

9. The combination comprising:

a building wall having an opening therein;

a rolling shutter operable between a closed position covering said opening and an open position uncovering at least a portion of said opening, and having a plurality of shutter slats;

a roller connected to the rolling shutter to roll the shutter thereupon for uncovering said opening, and to roll the shutter therefrom to close said opening;

locking slat means connected between the roller and the shutter slats;

guides adjacent said opening and receiving the shutter therein during the closing of said opening;

locking slat guide means secured to the building wall and disposed to guide the locking slats during rolling and unrolling thereof with respect to said roller, but clear the shutter slats during rolling thereof onto and off said roller, said locking slat guide means precluding the disarrangement of said locking slats when said shutter is closed and external force is applied thereto tending to open said shutter, whereby said locking slats hold the shutter closed.

10. The combination of claim 9 and further comprising:

spring means maintaining engagement of at least one of said locking slats against said locking slat guide surface during the rolling and unrolling of said locking slats from said roller and while said shutter is closed.

11. The combination of claim 10 wherein:

said guide means include a pair of guide blocks horizontally spaced outboard of the ends of the shutter slats but inboard of the ends of the locking slats.

12. The combination of claim 11 wherein:

said spring means are curved leaf springs having one end affixed to said roller and the other end engaging at least one of said locking slats and intermediate portions thereof in close proximity to said locking slats to maintain an orderly relationship of said locking slats with respect to each other and with respect to said guide surfaces.

* * * * *